United States Patent [19]

Dulis et al.

[11] Patent Number: 4,839,139

[45] Date of Patent: Jun. 13, 1989

[54] POWDER METALLURGY HIGH SPEED TOOL STEEL ARTICLE AND METHOD OF MANUFACTURE

[75] Inventors: Edward J. Dulis, Pittsburgh, Pa.; Carl J. Dorsch, North Chili, N.Y.; William Stasko, West Homestead, Pa.

[73] Assignee: Crucible Materials Corporation, Pittsburgh, Pa.

[21] Appl. No.: 832,734

[22] Filed: Feb. 25, 1986

[51] Int. Cl.[4] ..... C22C 1/05

[52] U.S. Cl. ..... 419/35; 419/13; 419/14; 419/28; 419/64

[58] Field of Search ..... 419/13, 14, 28, 35, 419/53, 64

[56] References Cited

U.S. PATENT DOCUMENTS

| | | | |
|---|---|---|---|
| Re. 32,117 | 4/1986 | Weaver | 29/423 |
| 3,145,458 | 8/1964 | Kloepfer et al. | 29/182.5 |
| 3,185,566 | 5/1965 | Galovche | 419/13 |
| 3,736,107 | 5/1973 | Hale | 29/182.7 |
| 3,837,068 | 9/1974 | Dunn | 29/420.5 |
| 3,869,319 | 3/1975 | Ishihara et al. | 148/31.5 |
| 3,994,692 | 11/1976 | Rudy | 29/182.5 |
| 4,323,395 | 4/1982 | Li | 75/212 |
| 4,452,756 | 6/1984 | McLeod | 419/29 |
| 4,483,820 | 11/1984 | Schelb | 419/28 |
| 4,499,049 | 2/1985 | Hanejko | 419/49 |

FOREIGN PATENT DOCUMENTS

| | | | |
|---|---|---|---|
| 4423410 | 10/1969 | Japan | 419/53 |
| 60-169549 | 9/1985 | Japan | 419/14 |
| AU83/00072 | 12/1983 | PCT Int'l Appl. | 419/35 |
| 2038882 | 7/1980 | United Kingdom | 419/28 |

*Primary Examiner*—Stephen J. Lechert Jr.
*Assistant Examiner*—Eric Jorgensen
*Attorney, Agent, or Firm*—Finnegan, Henderson, Farabow, Garrett & Dunner

[57] ABSTRACT

A powder metallurgy produced high speed tool steel article comprising a mixture of prealloyed high speed tool steel particles coated with a hard, wear resistant material, such as a carbide or nitride, mixed with prealloyed high speed tool steel uncoated particles; the particles are compacted to essentially full density and the hard, wear resistant material is at the boundaries of the coated particles and contained in a continuous matrix of the high speed tool steel. The article is produced by hot compacting a particle charge to essentially full density of a mixture of the coated and uncoated particles.

15 Claims, 4 Drawing Sheets

POWDER METALLURGY HIGH SPEED TOOL STEEL ARTICLE AND METHOD OF MANUFACTURE

BACKGROUND OF THE INVENTION

High speed tool steel articles including intermediate articles of rod and bar and finished articles such as tool bits and the like, must be characterized by good wear resistance for high speed cutting applications as well as good tool life. Wear resistance in high speed tool steels is a function generally of a dispersion of hard, wear resistant material, typically carbides of carbide forming elements such as vanadium, tungsten and molybdenum. Nitrides may also be present for this purpose. The higher the content of the dispersion of hard, wear resistant material the better will be the wear resistance of the article made therefrom. As the dispersion is increased, however, it tends to cause embrittlement of the article, which impairs the tool life. Specifically, after repeated use in high speed cutting applications and the like the article will fail as by cracking. By the use of powder metallurgy techniques to produce high speed tool steel articles, such as by hot isostatic compacting prealloyed powders thereof, combinations of high density and fine, uniform carbide dispersions have been obtained to achieve improved combinations of tool life and wear resistance during high speed cutting applications. Nevertheless, at extremely high concentrations of the hard, wear resistant material, such as carbides, tool life is impaired.

SUMMARY OF THE INVENTION

It is accordingly a primary object of the present invention to provide a powder metallurgy produced high speed tool steel article and method for manufacturing the same wherein dispersions of hard, wear resistant material may be provided to achieve heretofore unobtainable combinations of wear resistance and tool life.

Broadly, in accordance with the method of the invention, a powder metallurgy produced high speed tool steel article having an improved combination of tool life and wear resistance is produced by first providing a particle charge of high speed tool steel particles with the charge constituting a mixture of coated particles and uncoated particles. The coated particles are coated with a hard, wear resistant material, which may be carbides, nitrides or combinations thereof. The particle charge is hot isostatic compacted to essentially full density to produce the article. The coated particles may be present in an amount effective to improve tool life and wear resistance of the article. Specifically, the coated particles may be present in an amount of over 10 to 90%, or alternately 15 to 85% or about 50%. After hot isostatic compacting the article may be hot worked, which includes forging. The resulting article comprises a mixture of the coated prealloyed high speed tool steel particles and uncoated particles wherein the hard, wear resistant material of the coated particles is at boundaries of the coated particles and contained in a continuous matrix of the high speed tool steel.

Figure 1A:
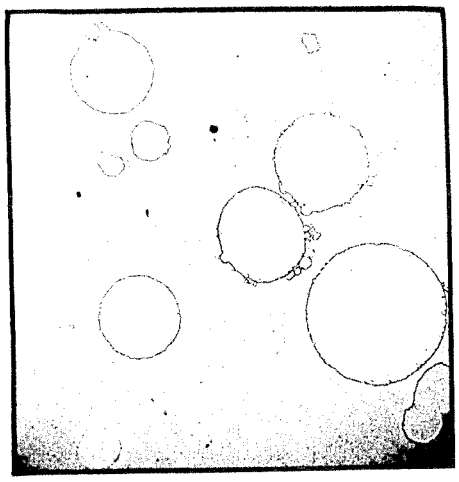
FIGS. 1A and B are photomicrographs of articles produced in accordance with the invention at a magnification of 30×.

These drawings, which are incorporated in and constitute a part of this specification, illustrate embodiments of the invention and together with the description serve to explain the principles of the invention.

DESCRIPTION OF THE PREFERRED EMBODIMENTS

In demonstrating the method and article of the invention gas atomized, prealloyed powder of the high speed tool steel composition designated as T15 was used. The experiments involved the use of different mesh size powders and different weight fractions of coated and uncoated powder particles. The coating constituting the hard, wear resistant material was a dual coating of titanium nitride on titanium carbide applied by chemical vapor deposition. The composition of the T15 high speed tool steel prealloyed powder was, in percent by weight, carbon 1.56, chromium 4.08, vanadium 4.57, tungsten 11.40, molybdenum 0.38, cobalt 5.0, nitrogen 0.032, titanium 0.02 and balance iron. The prealloyed powder particles were produced from the T15 composition by atomizing a molten stream of the alloy with nitrogen to form the discrete particles which were thereafter cooled to solidification and collected. The atomization was performed in an inert atmosphere to protect the particles from contamination, as by oxidation.

In the chemical vapor deposition (CVD) process, the coating produced is a product of gas reactions occurring at elevated temperatures inside a stainless steel retort chamber. The powder to be coated was spread to a depth of approximately ¼ inch over previously coated graphite shelves having a ½ inch high retaining lip around their outer edges. The shelves with the particles so positioned thereon were lowered into the retort. The retort was sealed, evacuated, filled with an inert atmosphere and heated to a temperature of approximately 1750° to 2000° F. in about 3 hours. The chamber was held at temperature for another 3 hours while the reaction gases were continuously introduced to the chamber. The gases used include argon which is introduced during the initial heating period and ammonia, nitrogen, methane, propane, hydrogen and titanium tetrachloride depending upon the composition of the coating desired. The resulting coating is chemically bonded to the surfaces of the powder particles. After coating the chamber is allowed to cool before removal of the coated powder. During the coating process, the powder is lightly bonded into a solid layer on the shelf. When the layer is removed it is mechanically broken-up to free the individual powder particles for subsequent use. Powder particles so coated were blended with uncoated T15 powder from the same heat and produced in the identical manner by inert gas atomization. Various powder samples of different portions of coated and uncoated particles were loaded in steel containers. The containers were vacuum outgassed, sealed and hot compacted by hot isostatic pressing in a gas pressure vessel employing nitrogen as the gaseous pressure medium at a pressure of approximately 12,500 psi. After hot compacting to essentially fully density, the compacts were forged to various size bars. Standard ½ inch square tool life test specimens were machined from the forged bars and heat treated in the manner conventional for T15 high speed tool steels. The resulting specimens were tested in continuous-cut tests on H13 alloy workpieces.

Figure 1B:
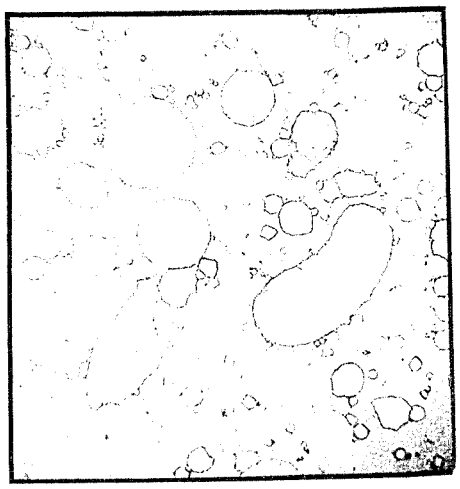
Figure 2A:
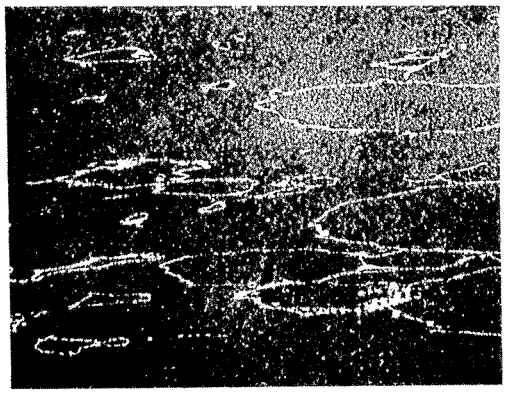
FIGS. 2A, B and C are photomicrographs of forged articles produced in accordance with the invention at a magnification of 65×.
Figure 2B:
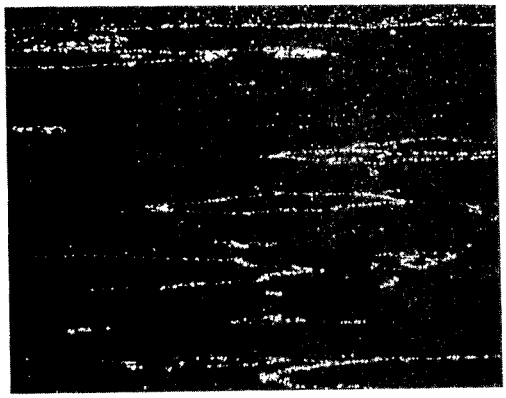
Figure 2C:
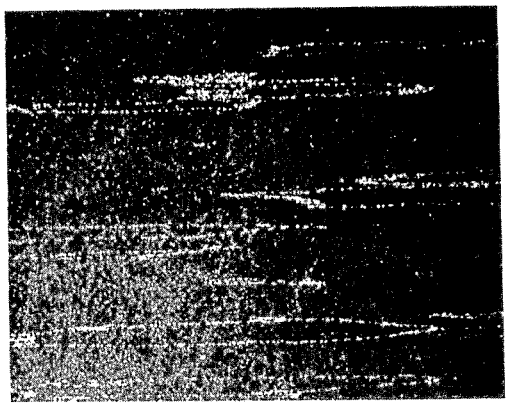
Figure 3A:
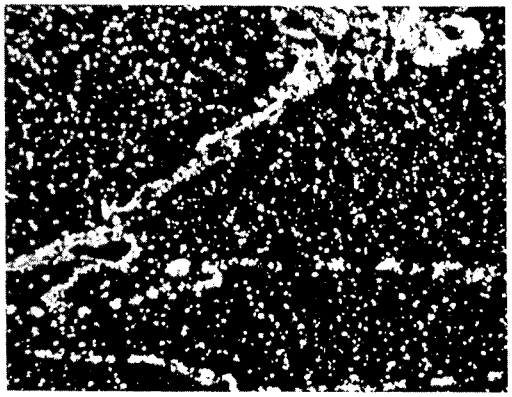
FIGS. 3A, B and C are photomicrographs of the articles of FIG. 2 but at a magnification of 500×.
Figure 3B:
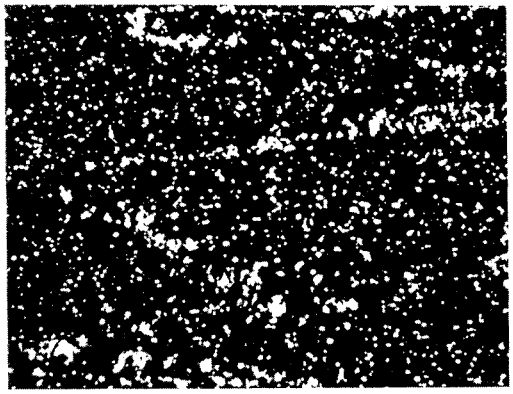
Figure 3C:
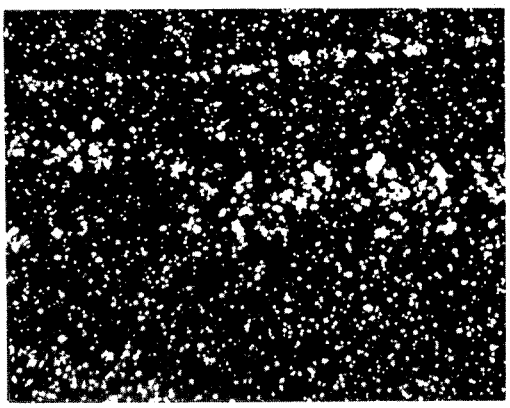

To illustrate the unique microstructure obtained by the practice of the invention, FIG. 1 shows the microstructure of hot compacted material wherein the coated particles are embedded in a continuous matrix of the high speed tool steel composition. After hot working as by forging the coated particles are dispersed further throughout the high speed tool steel matrix, as shown in FIGS. 2 and 3.

TABLE I

Continuous Cut Tool Life Test Results from Mixtures of Uncoated and Coated T15 Powder Tools

| Grade | Bar | Tool | HRC[1] | Time to Failure (Minutes)[2] Test Values | | Grade Average |
|---|---|---|---|---|---|---|
| 15% coated −16 mesh in | 84-4 | 1 | 68 | 25 | 38 | 38 |
| 85% uncoated −16 mesh | | 2 | 68 | 30 | 40 | |
| | | 3 | 68 | 50 | 45 | |
| 30% coated −16 mesh in | 84-5 | 1 | 68.5 | 40 | 25 | 35 |
| 70% uncoated −16 mesh | | 2 | 68.5 | 35 | 36 | |
| | | 3 | 68.5 | 45 | 28 | |
| 15% coated −120 mesh in | 84-6 | 1 | 68 | 50 | 25 | 44 |
| 85% uncoated −16 mesh | | 2 | 68 | 60 | 60 | |
| | | 3 | 68 | 44 | 25 | |
| 15% coated −16 mesh in | 84-7 | 1 | 68 | 70 | — | 43 |
| 85% uncoated −16 mesh | | 2 | 68 | 35 | 35 | |
| | | 3 | 68 | 35 | 40 | |
| 30% coated −16 mesh in | 84-8 | 1 | 68.5 | 20 | 28 | 30 |
| 70% uncoated −120 mesh | | 2 | 68.5 | 25 | 30 | |
| | | 3 | 68.5 | 50 | 24 | |
| 10% coated −16 mesh in | 84-9 | 1 | 68 | 20 | 28 | 27 |
| 90% uncoated −120 mesh | | 2 | 68 | 25 | 22 | |
| | | 3 | 68 | 42 | 22 | |
| 30% coated −120 mesh in | 83-12 | H | 68.5 | 30 | 20 | 29 |
| 70% uncoated −30 mesh | | J | 68.5 | 30 | 35 | |
| CPM T15, 100% uncoated | 81-33 | Z4 | 67.5 | 39 | 20 | 27 |
| | | Z5 | 67.5 | 30 | 15 | |
| | | Z6 | 67.5 | 25 | 25 | |
| | 81-51 | C | 67.5 | 29 | 30 | |
| | 74-47 | 1 | 68 | 32 | 25 | |

[1]All tools hardened:
2250° F., 5 minutes, oil quenched
1025° F., 2+2+2 hours
[2]Cutting Conditions:
Speed - 45 sfpm
Feed - .0055 in./rev.
Depth - .0625 in.
No lubrication
Workpiece - H13 at HRC 40

Table I shows the results of tool life tests with various mixtures of uncoated and coated powders constituting the charge from which the samples were produced for testing. As shown in Table I, in continuous-cut testing on H13 alloy workpieces the tools tested from bars 84-6 and 84-7 exhibited approximately 60% improvement in tool life over conventional uncoated powder metallurgy produced tools designated as CPM T15. This material was obtained from standard commercial bar stock. Tools from bar 84-4 exhibited a 40% improvement and tools from bar 84-5 a 28% improvement over this conventional material. Tools from bars 84-8, 84-9 and 83-12 performed only comparably to the conventional CPM T15 product.

TABLE II

Crossed Cylinder Wear Test Results from Mixtures of Uncoated and Coated T15 Powder Materials

| Powder Mixtures | Bar No. | HRC[1] | Wear Resistance ($10^{10}$ psi) Test Values | Average |
|---|---|---|---|---|
| 10% coated −120 mesh in 90% uncoated −30 mesh | 83-11 | 68.5 | 123, 102, 77, 79, 88 | 94 |
| 30% coated −120 mesh in 70% uncoated −30 mesh | 83-12 | 69.5 | 132, 124, 135, 143, 151 | 137 |
| 15% coated −16 mesh in 85% uncoated −16 mesh | 84-4 | 67.5 | 75, 96, 78, 79 | 82 |
| 30% coated −16 mesh in 70% uncoated −16 mesh | 84-5 | 68 | 97, 79, 77, 87 | 85 |
| 15% coated −120 mesh in 85% uncoated −16 mesh | 84-6 | 67.5 | 79, 84, 68, 87 | 80 |
| 15% coated −16 mesh in 85% uncoated −16 mesh | 84-7 | 67.5 | 79, 99, 101, 91 | 93 |
| 30% coated −16 mesh in 70% uncoated −120 mesh | 84-8 | 68.5 | 65, 76, 67, 58 | 67 |
| 10% coated −16 mesh in 70% uncoated −120 mesh | 84-9 | 67.5 | 62, 84, 60, 81 | 72 |
| CPM T15, 100% uncoated | | 67 | | 55–60 |

[1]All speciments hardened:
2250° F., 5 minutes, oil quenched
1050° F., 2+2+2 hours Table II provides the results of cross-cylinder wear tests with various coated and uncoated powder mixtures compared to a conventional CPM T15 material which contains only uncoated particles. As may be seen from Table II all the coated powder mixture materials in accordance with the invention exhibited superior wear resistance compared to the standard material.

TABLE III

Tool Life Test Results with Uncoated and Coated Powder T15

| Powder Mixtures | HRC | Time to Failure, Continuous Cut (Minutes) Test 1 | Test 2 | Average |
|---|---|---|---|---|
| CPM, T15 100% uncoated[1] | 67 | 10 | 10 | 9.5 |
| | 67 | 9 | 9 | |
| 15% coated[1] | 67 | 17 | 13 | |
| | 67 | 13 | 10 | 13.3 |
| 50% coated[1] | 68 | 24.5 | 18 | |
| | 68 | 20 | 20 | 20.6 |
| 100% coated[2] | 68 | 8 | 7 | |
| | 68 | 6 | 8 | 7.3 |

[1]2240° F., 5 min, oil quenched
1025° F., 2+2+2 hrs
[2]2225° F., 5 min, oil quenched
1025° F., 2+2+2 hrs
Test Conditions:
50 sfm
0.0055 in/rev.
0.0625 in depth
No lubrication
Workpiece - H13 at HRC C40

Figure 4:
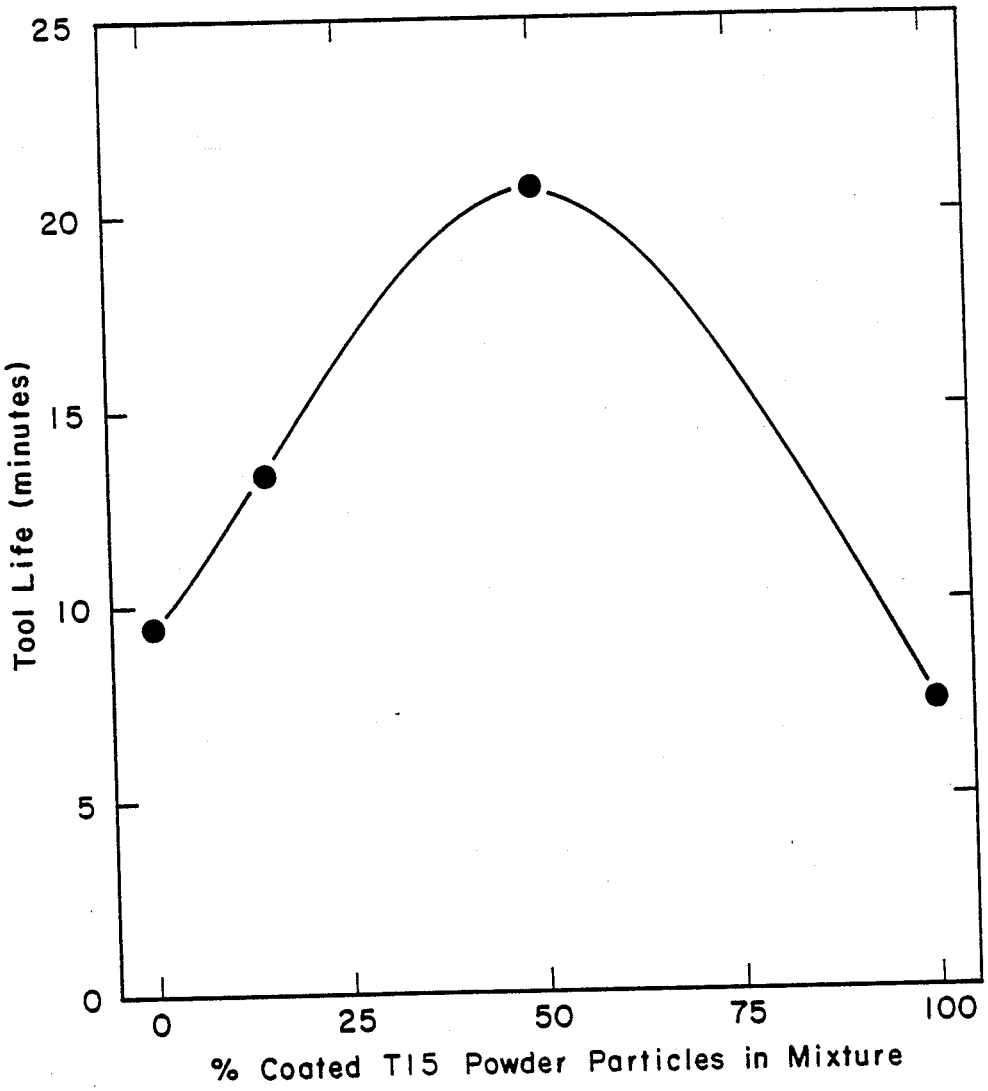
FIG. 4 is a cruve relating tool life to the percent of coated prealloyed powder in the mixture constituting the compacted article.

To determine the effect of varying additions of coated particles in increased amounts in the mixture, samples were produced containing 50% coated and 50% uncoated T15 powder particles as well as 100% coated mixtures. The material was processed in a manner identical to that described with reference to the test reported in Table I. The test results are shown in Table III and FIG. 4 of the drawings. As may be seen, the optimum performance with respect to tool life was obtained with the tools made from 50% coated and 50% uncoated mixtures of powder particles. Over a 100% improvement in tool life was found for the 50% coated and 50% uncoated material when compared to the standard CPM T15. The 100% coated particle sample tool showed a tool life of less than that obtained for the standard CPM T15 tool, which contained only uncoated particles.

Although the invention has been demonstrated with respect to prealloyed powder particles of T15 high speed tool steel, it is to be understood that the invention is applicable to any cutting tool alloy where it is desired to increase the dispersion of the hard, wear resistant phase, particularly a carbide phase distribution. The invention is amenable to use of any of the well known carbide forming elements and carbides therefrom which typically are used in cutting tool alloys for the purpose of providing the required hard, wear resistant dispersion. This may include vanadium, molybdenum and tungsten carbides which may be used singly, but conventionally in most cases are combined in a specific high speed tool steel composition used in cutting tool applications. The invention may be used to produce by hot compacting, and specifically hot isostatic compacting, either intermediate products in the form of billets, bar or rod or final pressed-to-shape articles, such as tool bits.

We claim:

1. A method for producing a powder-metallurgy produced high-speed tool steel article having an improved combination of tool life and wear resistance, said method comprising providing a particle charge of high-speed steel particles constituting a mixture of coated high-speed steel particles coated with a hard, wear resistant material and uncoated high-speed steel particles, said coated particles being present in an amount effective to improve tool life and wear resistance of said article and hot compacting said particle charge to essentially full density to produce said article.

2. The method of claim 1 wherein said coated particles are present in an amount of over 10 to 90%.

3. The method of claim 1 wherein said coated particles are present in an amount of 15 to 85%.

4. The method of claim 1 wherein said coated particles are present in an amount of about 50%.

5. A method for producing a powder-metallurgy produced high-speed tool steel article having an improved combination of tool life and wear resistance, said method comprising providing a particle charge of high speed tool steel particles constituting a mixture of coated high-speed steel particles coated with a hard, wear resistant material and uncoated high-speed steel particles, said coated particles being present in an effective amount to improve tool life and wear resistance of said article, hot compacting said particle charge to produce an essentially fully dense article and hot working said essentially full dense article.

6. The method of claim 5 wherein said hot working includes forging.

7. The method of claim 5 wherein said coated particles are present in an amount of over 10 to 90%.

8. The method of claim 5 wherein said coated particles are present in an amount of 15 to 85%.

9. The method of claim 5 wherein said coated particles are present in an amount of about 50%.

10. A method for producing a powder-metallury produced high-speed tool steel article having an improved combination of tool life and wear resistance, said method comprising providing a particle charge of high speed tool steel particles constituting a mixture of coated high-speed steel particles coated with a hard, wear resistant material selected from the group consisting of carbides, nitrides and combinations thereof and uncoated high-speed steel particles, said coated particles being present in an effective amount to improve tool life and wear resistance of said article and hot compacting said particle charge to essentially full density to produce said article.

11. The method of claim 10 wherein said article is hot worked after hot compacting.

12. The method of claim 11 wherein said hot working includes forging.

13. The method of claim 10 wherein said coated particles are present in an amount of over 10 to 90%.

14. The method of claim 10 wherein said coated particles are present in an amount of 15 to 85%.

15. The method of claim 10 wherein said coated particles are present in an amount of about 50%.

* * * * *